US006227540B1

(12) United States Patent
Nakamura et al.

(10) Patent No.: US 6,227,540 B1
(45) Date of Patent: May 8, 2001

(54) SHEET CARRYING APPARATUS

(75) Inventors: Takashi Nakamura; Akira Terakado; Yasushi Hashimoto; Tatsuo Matsuda; Tatsuya Shiraishi; Jun Ogino, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/305,220

(22) Filed: May 5, 1999

(30) Foreign Application Priority Data

May 15, 1998 (JP) ..... 10-133373

(51) Int. Cl.[7] ..... B65H 39/10
(52) U.S. Cl. ..... 271/303
(58) Field of Search ..... 271/303, 304, 271/305

(56) References Cited

U.S. PATENT DOCUMENTS 5,868,387 * 2/1999 Hortari et al. ..... 271/304
5,934,669 * 8/1999 Uchida et al. ..... 271/303
5,971,394 * 10/1999 Kida et al. ..... 271/303

FOREIGN PATENT DOCUMENTS

0041348 * 2/1988 (JP) ..... 271/303
0117833 * 5/1988 (JP) ..... 271/303
405319656 * 12/1993 (JP) ..... 271/303

* cited by examiner

*Primary Examiner*—H. Grant Skaggs
(74) *Attorney, Agent, or Firm*—Sughrue, Mion, Zinn, Macpeak & Seas, PLLC

(57) ABSTRACT

A sheet carrying apparatus (2) includes: a sheet receiving means (6, 16) for receiving a sheet ejected from a sheet output device (1); a first carrying path (7) for guiding the sheet; a second carrying path (8) branched out of the first carrying path; a carrying path switching means (9) provided in a branching portion between the first and second carrying paths; a first receiving device attachment portion (11) for detachably holding a first receiving device (3) for receiving the sheet ejected from the first carrying path; and a second receiving device attachment portion (12) for detachably holding a second receiving device (4) for receiving the sheet ejected from the second carrying path.

1 Claim, 1 Drawing Sheet

FIGURE
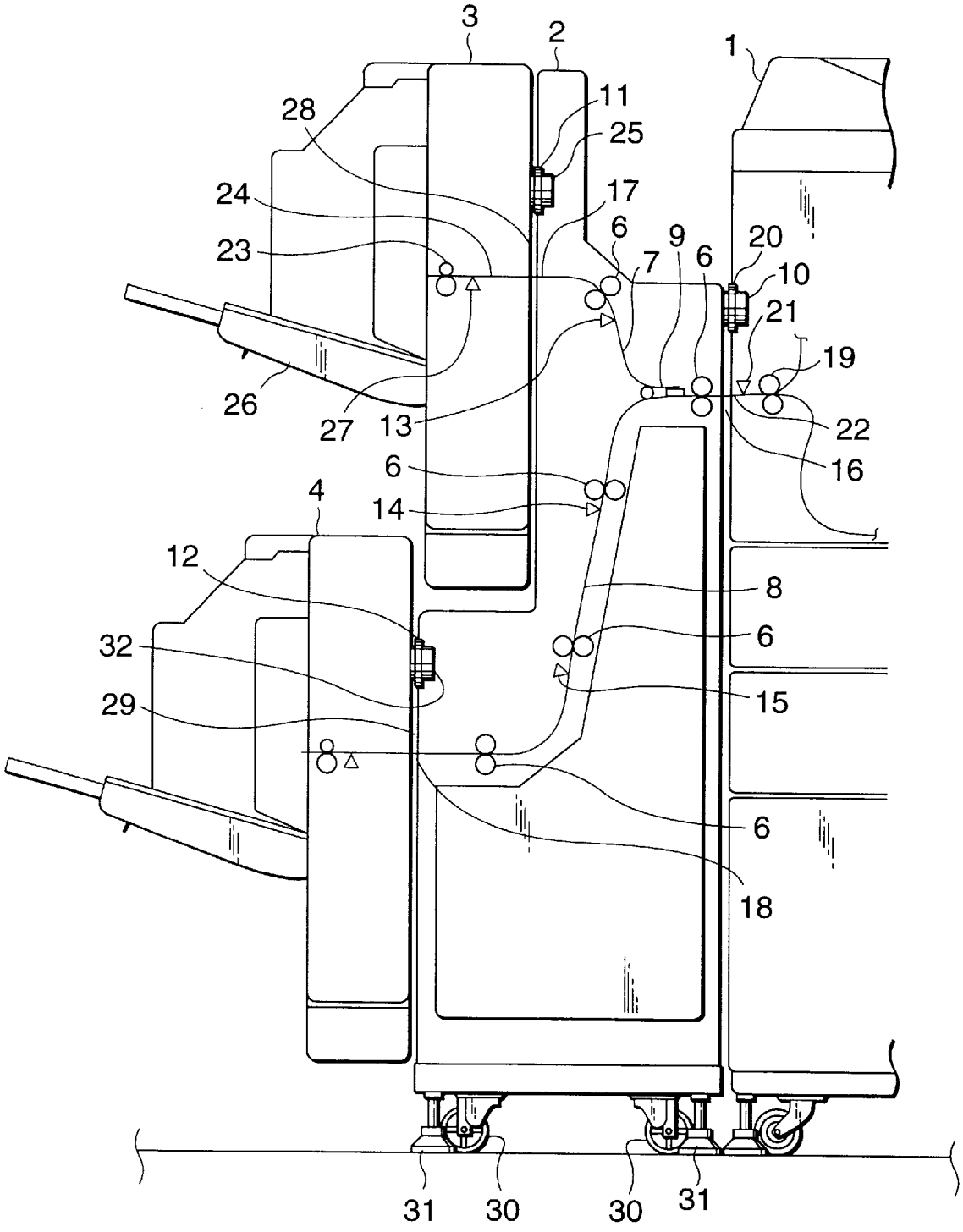

SHEET CARRYING APPARATUS

BACKGROUND OF THE INVENTION

1. Field of the Invention

The present invention relates to a sheet carrying apparatus for carrying a sheet, which is ejected by a sheet output device, to a sheet receiving device.

2. Description of the Related Art

In a sheet output device for applying predetermined processing to sheet materials such as paper, OHP sheets, or the like, and successively ejecting sheets out of the device, it is general that a tray for stacking and receiving sheets ejected from the sheet output device is provided in an ejection portion of the sheet output device. In the case where the number of sheets ejected onto the tray at a time is small, in the case where sheets ejected onto the tray are taken out by an operator soon, or in any other similar cases, the aforementioned tray is often satisfactory. However, in the case where the number of sheets ejected at a time is large, in the case where it is not necessary for an operator to take the ejected sheets out soon, in the case where the ejected sheets cannot be taken out, or in any other similar cases, hundreds of sheets or thousands of sheets are stacked in a short time so that there arises a situation in which the aforementioned tray is unsatisfactory. Therefore, conventionally, in a sheet output device requiring such a large-capacity sheet stacking portion, a large-capacity sheet receiving device such as a stacker, or the like, having a sheet stacking tray provided so as to be able to up/down relative to the ejection portion of the sheet output device is connected to the sheet output device to thereby increase the capacity of the sheet stacking portion.

As described above, in the background art, some types of large-capacity sheet receiving devices such as a sheet receiving device capable of receiving 1500 sheets, a sheet receiving device capable of receiving 3000 sheets, etc., were prepared so that selected one of the sheet receiving devices was connected to the sheet output device. Accordingly, on the maker's side, there was a problem that they had to cost much time for development and design of sheet receiving devices individually. It could not be said that this manner was wise. On the other hand, on the user's side, there was an economical problem as follows. For example, assume that a user purchased a sheet output device with a sheet receiving device capable of receiving 1500 sheets. If the user wished thereafter to replace the sheet receiving device by a sheet receiving device capable of receiving 3000 sheets, the sheet receiving device capable of receiving 1500 sheets which was detached from the sheet output device became useless.

Further, also in terms of handling characteristic, a sheet receiving device capable of receiving 3000 sheets has an advantage that the loading capacity increases but the sheet receiving device has a disadvantage that the increase of the loading capacity makes the work of taking-out sheets difficult. Further, the sheet receiving device capable of receiving 3000 sheets has a tendency that sheet alignment characteristic on the sheet stacking tray is lowered compared with the sheet receiving device capable of receiving 1500 sheets. Taking into account the case where the sheet output device has means for applying after-processing such as bookbinding, or the like, to the ejected sheets, worsening of the sheet alignment characteristic is a fatal defect.

SUMMARY OF THE INVENTION

The present invention has been made to solve the above problem with the conventional apparatus, and therefore an object of the present invention is to provide a sheet carrying apparatus in which increase of the sheet loading capacity of a sheet receiving device can be attained without change of the sheet receiving device per se. Another object of the present invention is to provide a sheet carrying apparatus in which the sheet loading capacity can be increased without spoiling both the efficiency in taking stacked sheets out and alignment characteristic of the stacked sheets.

The foregoing objects are achieved by a sheet carrying apparatus characterized by comprising: a sheet receiving means for receiving a sheet ejected from a sheet output device; a first carrying path for guiding said sheet received by said sheet receiving means; a second carrying path branched out of said first carrying path; a carrying path switching means provided in a branching portion between said first and second carrying paths; a first receiving device attachment portion for detachably holding a first receiving device for receiving said sheet ejected from said first carrying path; and a second receiving device attachment portion for detachably holding a second receiving device for receiving said sheet ejected from said second carrying path.

BRIEF DESCRIPTION OF THE DRAWINGS

FIGURE is a configuration view showing an embodiment of the present invention.

DETAILED DESCRIPTION OF THE PREFERRED EMBODIMENTS

An embodiment of the present invention will be described below with reference to FIGURE. Incidentally, in this embodiment, the case where the sheet output device is an image forming device known as a printer, a copying machine, or the like will be described as an example.

In the drawing, the reference numeral 1 designates an image forming device (hereinafter referred to as "printer" simply); 2, a sheet carrying apparatus (hereinafter referred to as "intermediate unit") as a subject of the present invention; and 3 and 4, sheet receiving devices (hereinafter referred to as "stackers").

The intermediate unit 2 comprises: carrying rollers 6 as a sheet receiving means for receiving a sheet ejected from a printer 1; a first carrying path 7 for guiding the sheet carried by the carrying rollers 6 in a predetermined direction; a second carrying path 8 branched out of the carrying path 7; a flapper 9 as a carrying path switching means provided in a branching portion between the carrying paths 7 and 8; a stacker attachment portion 11 for detachably holding a stacker 3 for receiving the sheet ejected from an ejection port 17 of the carrying path 7; and a stacker attachment portion 12 for detachably holding a stacker 4 for receiving the sheet ejected from an ejection port 18 of the carrying path 8. Incidentally, in the intermediate unit 2, the reference numerals 13, 14 and 15 designate sheet detection sensors; 30, casters; and 31, leveling bolts.

When a mounting member 10 provided in the intermediate unit 2 is connected to a stacker attachment portion 20 originally provided in the printer 1 for attaching the stacker 3 or 4, a sheet receiving port 16 of the intermediate unit 2 is connected to a sheet ejection port 22 of the printer 1 so that a sheet discharged from the printer 1 is received in the intermediate unit 2. The carrying rollers 6 are disposed in suitable positions of the carrying paths 7 and 8 so that the sheet discharged from the printer 1 and received in the intermediate unit 2 through the sheet receiving port 16 of the intermediate unit 2 is carried to the stacker 3 or 4.

The carrying path 7 connects the sheet receiving port 16 of the intermediate unit 2 to the sheet receiving port 28 of the stacker 3 connected to the stacker attachment portion 11. The carrying path 8 connects the branching portion between the carrying paths 7 and 8 to the sheet receiving port 29 of the stacker 4 connected to the stacker attachment portion 12. The carrying paths 7 and 8 are provided so as to carry sheets discharged from the printer 1 to the stackers 3 and 4 respectively by the carrying rollers 6 of the intermediate unit 2.

The flapper 9 for distributing sheets discharged from the printer 1 to the carrying paths 7 and 8 is provided in the branching portion between the carrying paths 7 and 8 so as to switch the sheet carrying direction by designation of one of the stackers.

Further, sheet detection sensors 13, 14 and 15 for detecting a carried sheet are provided in the intermediate unit 2. The sheet detection sensor 13 performs detection of a jam of carried sheets in the carrying path 7. Similarly, each of the sheet detection sensors 14 and 15 performs detection of a jam of carried sheets in the carrying path 8. When a jam of carried sheets is detected by one of the sheet detection sensors 13, 14 and 15, the carrying operation is stopped by a controller not shown. Sheets left in the intermediate unit 2 because of a jam can be removed from the intermediate unit 2 when a cover (not shown) provided so as to open the carrying paths 7 and 8 is opened.

Further, casters 30 for supporting a body of the apparatus and making the body of the apparatus movable are provided in the intermediate unit. 2. Leveling bolts 31 for fixing the intermediate unit 2 are provided in the peripheries of the casters 30 so as to prevent the intermediate unit 2 from falling over, or the like.

The operation of the thus configured intermediate unit 2 at the time of stacking of sheets will be described below.

A sheet ejected from sheet-ejection rollers 19 provided in the printer 1 is taken in the intermediate unit 2 through the sheet receiving port 16 of the intermediate unit 2 and carried in the carrying path 7 by the carrying rollers 6. Assuming now that the place where the sheet is discharged is set to the stacker 3, then the sheet carrying path is switched to the carrying path 7 by the flapper 9 so that the sheet is carried to the stacker 3. Assuming now that the place where the sheet is discharged is set to the stacker 4, then the sheet carrying path is switched to the carrying path 8 by the flapper 9 so that the sheet is carried to the carrying path 8 through the branching portion between the carrying paths 7 and 8 and carried to the stacker 4 by the carrying rollers 6. The sheets carried thus to the stacker 3 or 4 are stacked and received on the stacking tray 26 which is provided in the stacker so as to be able to up/down. Because the stackers 3 and 4 offset in the horizontal direction, there is no barrier both to efficiency in the work of taking-out sheets and to sheet alignment characteristic on the stacking tray.

By the aforementioned configuration, when, for example, the stacker 3 has been purchased at the time of purchase of the printer 1 and the increase of the loading capacity is required after that, the capacity can be doubled while the stacker 3 is used continuously if the intermediate unit 2 and the stacker 4 are purchased and connected. Further, in this embodiment, a mechanism (10, 20) for connecting the printer 1 and the intermediate unit 2 to each other, a mechanism (11, 25) for connecting the intermediate unit 2 and the stacker 3 to each other and a mechanism (12, 32) for connecting the intermediate unit 2 and the stacker 4 to each other are designed to have one and the same configuration. Accordingly, the positions of the stackers 3 and 4 relative to the intermediate unit 2 can be changed.

As described above, according to the present invention, there can be provided a sheet carrying apparatus in which increase of the sheet loading capacity of a sheet receiving device can be attained without change of the sheet receiving device per se. Further, there can be provided a sheet carrying apparatus in which the sheet loading capacity can be increased without spoiling both the efficiency in taking stacked sheets out and alignment characteristic of the stacked sheets.

What is claimed is:

1. A sheet carrying apparatus comprising:

a sheet receiving device for receiving a sheet ejected from a sheet output device, the sheet receiving device defining a first sheet carrying path for guiding the sheet received by the sheet receiving device, the sheet receiving device defining a second sheet carrying path branched out of the first carrying path for guiding the sheet received by the sheet receiving device, the sheet receiving device comprising a switching mechanism for switching the first and second sheet carrying paths to feed the sheet to one of the first and second sheet carrying paths;

a first receiving device for receiving the sheet ejected from the first carrying path;

a second receiving device for receiving the sheet ejected from the second carrying path;

a first attachment mechanism for connecting detachably the first receiving device to the sheet receiving device;

a second attachment mechanism for connecting detachably the second receiving device to the sheet receiving device, wherein the first attachment mechanism has the same structure as that of the second attachment mechanism; and a third attachment mechanism for connecting detachably the sheet receiving device to the sheet output device, wherein the third attachment mechanism has the same structure as that of the first attachment mechanism.

* * * * *